US008490444B2

(12) United States Patent
Saari

(10) Patent No.: US 8,490,444 B2
(45) Date of Patent: Jul. 23, 2013

(54) WIRELESSLY CONTROLLED ELECTRIC LOCK

(75) Inventors: Simo Saari, Espoo (FI); Juha Saari, legal representative, Helsinki (FI)

(73) Assignee: Megalock Oy, Helsinki (FI)

( * ) Notice: Subject to any disclaimer, the term of this patent is extended or adjusted under 35 U.S.C. 154(b) by 0 days.

(21) Appl. No.: 13/143,212

(22) PCT Filed: Dec. 29, 2009

(86) PCT No.: PCT/FI2009/051046
§ 371 (c)(1),
(2), (4) Date: Jul. 5, 2011

(87) PCT Pub. No.: WO2010/076390
PCT Pub. Date: Jul. 8, 2010

(65) Prior Publication Data

US 2011/0265527 A1 Nov. 3, 2011

(30) Foreign Application Priority Data

Jan. 5, 2009 (FI) ..... 20095004
Mar. 23, 2009 (FI) ..... 20095298
Jun. 18, 2009 (FI) ..... 20095694

(51) Int. Cl.
*E05B 47/00* (2006.01)

(52) U.S. Cl.
USPC ..... 70/277; 70/278.3; 70/279.1; 70/283; 70/278.7

(58) Field of Classification Search
USPC ..... 70/107, 277, 278.2–278.7, 279.1, 70/280–283.1
See application file for complete search history.

(56) References Cited

U.S. PATENT DOCUMENTS 4,148,092 A * 4/1979 Martin ..... 361/172
4,802,353 A * 2/1989 Corder et al. ..... 70/277

(Continued)

FOREIGN PATENT DOCUMENTS

DE 93 18 001.2 U1 3/1995
DE 44 38 472 A1 6/1995

(Continued)

OTHER PUBLICATIONS

Examination Report dated Jan. 5, 2012 for Finnish priority Application No. 20095694.

(Continued)

*Primary Examiner* — Suzanne Barrett
(74) *Attorney, Agent, or Firm* — Ladas & Parry LLP

(57) ABSTRACT

The invention relates to a wirelessly controlled electric lock, comprising a lock body (2*a*), a key cylinder (2*b*), a turn spindle (3) rotatable by a handle element (3*a*) internal of the door, the turning of which enables opening of the lock, an opening spindle (4) rotatable by an opening element (5) external of the door, a drive link mechanism (41, 20, 21, 22) enabling the turn spindle (3) and the opening spindle (4) to be coupled with each other for a drive link engagement, such that turning of the opening spindle translates also into a turning motion of the turn spindle. The lock also comprises electrically controlled coupling elements (10, 21, 22, 24, 25, 26), including a piezoelectric actuator (10) which, in a mode activated by an electrical control (12, 31, 33) transmitted (32) wirelessly to the electrical lock, is adapted to fixedly lock a bolt or plunger (10*a*) which, in its fixedly locked condition, activates said drive link engagement as the opening spindle (4) is turned. Without electrical control of the actuator (10), said bolt or plunger (10*a*), upon yielding to the weak returning force of a spring, is adapted to disable or not to activate the coupling of the drive link engagement as the opening spindle (4) is rotated.

10 Claims, 6 Drawing Sheets

U.S. PATENT DOCUMENTS

| | | | | |
|---|---|---|---|---|
| 5,437,174 | A * | 8/1995 | Aydin | 70/278.3 |
| 5,473,236 | A * | 12/1995 | Frolov | 318/286 |
| 5,544,507 | A * | 8/1996 | Lin | 70/107 |
| 5,640,863 | A * | 6/1997 | Frolov | 70/283 |
| 5,775,142 | A * | 7/1998 | Kim | 70/277 |
| 5,946,955 | A * | 9/1999 | Suggs et al. | 70/218 |
| 5,987,945 | A * | 11/1999 | Ruano Aramburu | 70/277 |
| 6,286,347 | B1 * | 9/2001 | Frolov | 70/472 |
| 6,334,636 | B1 * | 1/2002 | Huang et al. | 292/144 |
| 6,581,426 | B2 | 6/2003 | Bates et al. | |
| 6,584,818 | B2 * | 7/2003 | Bates et al. | 70/432 |
| 6,585,302 | B2 * | 7/2003 | Lin | 292/142 |
| 6,612,141 | B2 * | 9/2003 | Bates et al. | 70/257 |
| 6,725,693 | B2 * | 4/2004 | Yu et al. | 70/107 |
| 6,758,070 | B2 * | 7/2004 | Yu et al. | 70/107 |
| 6,918,276 | B2 * | 7/2005 | Van Parys | 70/257 |
| 6,935,149 | B1 | 8/2005 | Peng et al. | |
| 7,007,526 | B2 * | 3/2006 | Frolov et al. | 70/277 |
| 7,188,495 | B2 * | 3/2007 | Errani et al. | 70/278.7 |
| 7,222,508 | B2 * | 5/2007 | Dickhans et al. | 70/279.1 |
| 7,231,791 | B2 * | 6/2007 | Sakai | 70/277 |
| 7,373,795 | B2 * | 5/2008 | Kilbourne | 70/278.1 |
| 7,516,633 | B1 * | 4/2009 | Chang | 70/472 |
| 7,872,577 | B2 * | 1/2011 | Frolov | 340/542 |
| 8,001,818 | B2 * | 8/2011 | Imedio Ocana et al. | 70/472 |
| 8,079,240 | B2 * | 12/2011 | Brown et al. | 70/277 |
| 8,141,400 | B2 * | 3/2012 | Sorensen et al. | 70/279.1 |
| 8,176,761 | B2 * | 5/2012 | Sorensen et al. | 70/279.1 |
| 2001/0005998 | A1 * | 7/2001 | Imedio Ocana | 70/277 |
| 2006/0150694 | A1 * | 7/2006 | Frolov et al. | 70/277 |
| 2007/0051145 | A1 * | 3/2007 | Chang | 70/279.1 |
| 2009/0173120 | A1 * | 7/2009 | Lin et al. | 70/279.1 |
| 2010/0089109 | A1 * | 4/2010 | Bliding et al. | 70/280 |

FOREIGN PATENT DOCUMENTS

| | | | |
|---|---|---|---|
| JP | 2007-239260 | A | 9/2007 |
| SE | 529 017 | C2 | 4/2007 |
| WO | 2004/048722 | A2 | 6/2004 |
| WO | 2004/077473 | A1 | 9/2004 |
| WO | 2007/049040 | A1 | 5/2007 |

OTHER PUBLICATIONS

Espacenet English abstract of SE 529 017 C2.

Espacenet English abstract of JP 2007-239260 A.

* cited by examiner

WIRELESSLY CONTROLLED ELECTRIC LOCK

The invention relates to a wirelessly controlled electric lock, comprising a lock body, a key cylinder, a turn spindle rotatable by a handle element internal of the door, the turning of which enables opening of the lock, an opening spindle rotatable by an opening element external of the door, a drive link mechanism enabling the turn spindle and the opening spindle to be coupled with each other for a drive link engagement, such that turning of the opening spindle translates also into a turning motion of the turn spindle, and electrically controlled coupling elements.

In commonly employed electric locks, the electrically controlled actuators receive operating power for themselves in a wired manner, because the power consumption is of such a magnitude that working in a battery-operated version is out of the question. When the power supply is arranged in a wired manner, the same cable is also adapted for a data communication link between an access control device and the lock.

The patent publication SE 529017 C2 discloses an electric lock of the above-mentioned type, wherein the objective is to replace conventional electric locks (so-called motor locks) with a solution in which the lock opening force is transmitted manually and the lock is passed to an opening position by means of solenoid-operated levers as the solenoid receives a current. However, the solenoid also has a power consumption of such a magnitude that the excessively frequent need to replace batteries makes this lock impractical. Also, this mains-current operated accessory is not practical for reasons relating to installation engineering.

Nevertheless, there would be a demand for such electric locks whose power consumption is sufficiently low for enabling in a battery-operated version to last for very long times, even several years, without a battery replacement.

In order to achieve this objective, it is an insight in the invention that the opening function must be based on the disablement of a bolt or plunger movement implemented by an electrically controlled actuator, as a result of which the energy consumption is extremely slight. Hence, the object of the invention is achieved on the basis of the characterizing features presented in the appended claim 1.

In a preferred embodiment of the invention, said disablement of a bolt or plunger movement is implemented by a piezoelectric actuator.

Because the electric lock of the invention does not need a wired supply of power from outside, it is convenient that the electric control output device is in the form of an access control device, which controls electric locks in several doors by means of short range signals. Such an arrangement provides for a major saving in costs with respect to available electric lock systems, which have an individual access control device for each door.

Still another advantage is achieved by the invention, based on the implementation that the electric lock includes a reception and control unit provided with a transmitter which is adapted to send a message to an access control device in case of unauthorized opening of the door without an opening command from the access control device. Thus, there is a two-way communication link between an electric lock of the invention and an access control device and the electric lock of the invention functions as a security lock, supplying an alarm system with a message about an unauthorized opening of the door. The electric lock of the invention receives a message about opening of the door, for example by means of a magnetic switch.

One exemplary embodiment of the invention will now be described with reference to the accompanying drawings, in which FIG. 1 shows a door-mounted electric lock of the invention in a cross-sectional side view;

Figure 1:
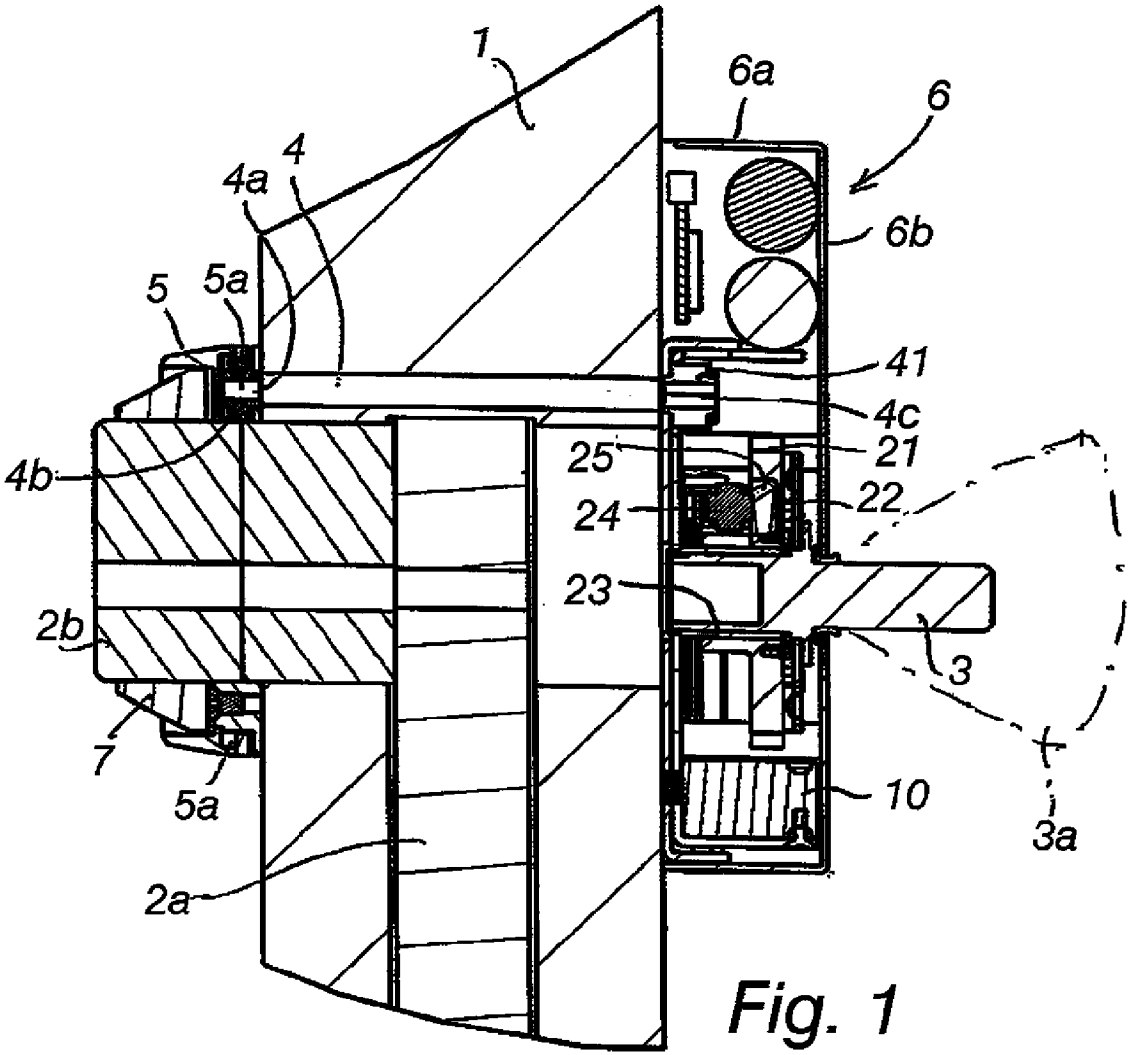

By means of the exemplary embodiment illustrated in the figures, a conventional lock can be converted from a key-operated lock into an electrically operated lock while retaining the key-operated opening function. Naturally, the lock according to the invention can also be implemented as a new type of construction, which is not openable with a key and in which the fittings of a housing 6 are constructed as parts connected with an actual lock body 2*a*.

The lock, in which the invention is applied, includes a turn spindle 3 driven by a handle element such as handle knob 3*a*, the handle knob 3*a* being located inside a door 1. Outside the door 1 is a key cylinder 2*b* normally used for opening the door. The key cylinder 2*b* is circular in cross-section.

In the illustrated embodiment, an opening element 5 external of the door is an annular finger wheel fitted around the key cylinder 2*b*. The opening element 5 is designed for rotation around the key cylinder 2*b*. The opening element 5 has the internal surface of its circular wall provided with an internal serration 5*a*. The opening element 5 is locked in a fixed position in the direction of its rotation axis by means of a ring lock 7.

A gear 4*b* present at a first end 4*a* of an elongated opening spindle 4 is set in the engagement with the serration 5*a* of the opening element 5 whereby, when the opening element 5 is rotated, the gear 4*b* and the opening spindle 4 are rotating. The opening spindle has its second end 4*c* adapted to extend into the interior of a housing 6 mounted internally of the door. The opening spindle has its end 4*c* provided with a gear 41, which is part of a drive link mechanism 41, 20, 21, 22 that enables coupling the turn spindle 3 and the opening spindle 4 with each other for a drive link engagement, such that rotation of the opening spindle 4 translates into a rotation motion of the turn spindle 3 as well. This drive link mechanism includes an axially displaceable gear 21, which is mounted on an axle 23 present as an extension of the turn spindle 3 and which, by way of an elongated transmission gear 20, is meshed with the gear 41 in all its displacement positions. A result of this is that, as the finger wheel 5 is rotated, the gears 41, 20 and 21 are always rotating. However, this rotary motion does not translate into rotation of the spindle 3 until the gear 21 is forced to move axially into contact with a coupling plate 22, such that spring protrusions 26 of the coupling plate 22 are pressed into recesses or between bosses present at a surface of the gear 21, resulting in a joint rotation of the gear 21 and the coupling plate 22. The coupling plate 22 is fixed on the axle of the turn spindle 3.

In order to create said drive link engagement, the invention provides electrically controlled coupling elements 10, 21, 22, 24, 25, 26, which are described in more detail hereinafter. These coupling elements include also the above-discussed gear 21 and the coupling plate 22.

Figure 4:
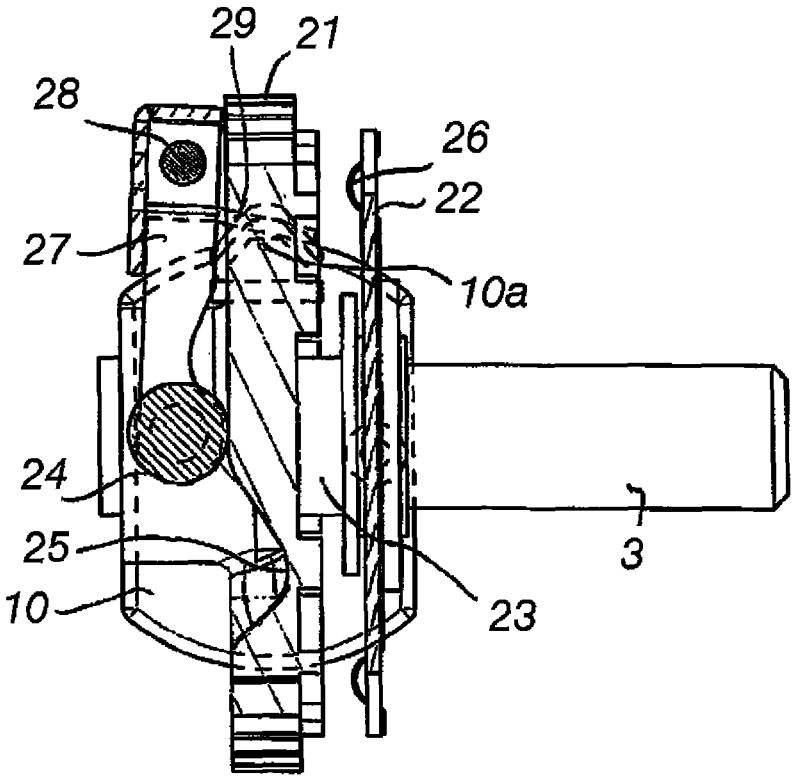
FIG. 4 shows an essential component of the electric lock in a side view, with the lock in a closed position.
Figure 6:
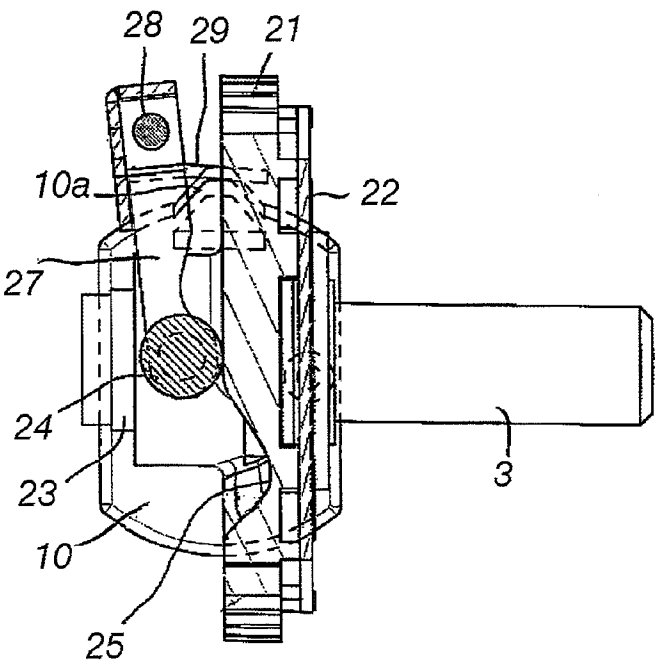
FIG. 6 is a view otherwise similar to FIG. 4 except showing the components in a position which enables opening of the lock.
Figure 5:
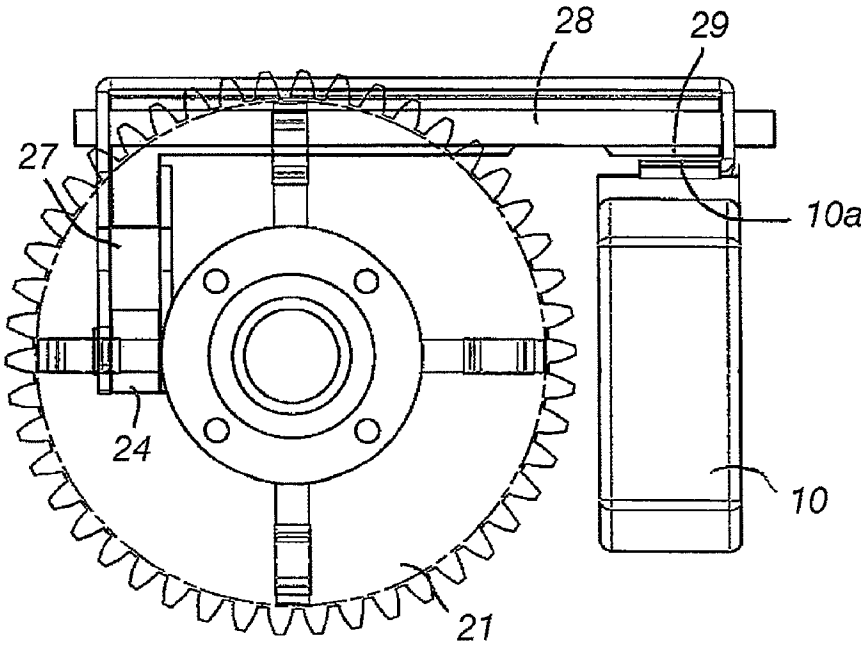
FIG. 5 shows the lock component of FIG. 6 as seen in the axial direction of a turn spindle 3.
Figure 7:
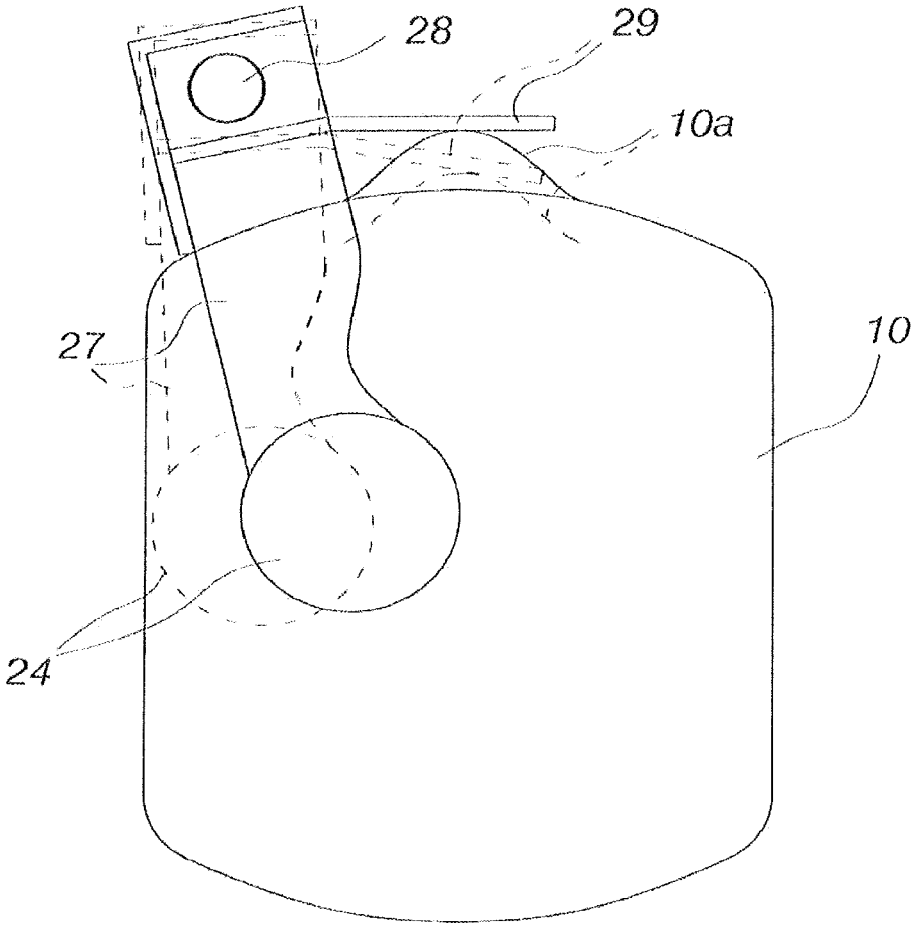
FIG. 7 shows separately the actuator 10 and the elements which are in direct cooperation with bolt or plunger 10*a*. The solid line shows the position of FIG. 6 and the dashed line shows the position of FIG. 4.
Figure 8:
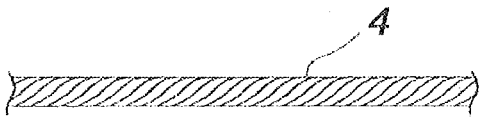
FIG. 8 shows the pliable wire cable 4.

As depicted particularly in FIGS. 4-6, the piezoelectric actuator 10, in a mode activated by electrical control, is adapted to fixedly lock a bolt or plunger 10*a* which in its fixedly locked position switches on said drive link engagement in response to rotating the opening spindle 4. In the position of FIG. 4, with the actuator 10 not receiving electrical control, the bolt or plunger 10*a*, upon yielding to the weak returning force of a spring or some other force device, is adapted to disable or not to activate the drive link engagement as the opening spindle 4 is turned. Thus, a cam wheel 24 is able to climb from a control recess 25 without axially displacing the gear 21, as the lever 27 is able to turn around its axle 28 and the bolt or plunger 10*a* is pressed down by a crank arm 29 associated with the lever 27. Hence, when applying rotation to the finger wheel 5, there is just a "click, click" sound audible at every turn of the gear 21 as the cam wheel 24 falls in and rises from the control recess 25.

When the piezoelectric actuator 10 receives electrical control for opening a door, the bolt or plunger 10*a* clamps in place or its return motion is only allowed over a very short distance, resulting, upon rotating the finger wheel 5, in the condition shown in FIG. 6, in which the turning of the lever 27, 29 is disabled by the bolt or plunger 10*a* after the cam wheel 24 has dropped into the control recess 25. At this point, the cam wheel 24 presses the axially displaceable gear 21 into contact with the coupling plate 22. As a result, rotating the finger wheel 5 sets also the turn spindle 3 in rotation. Opening of the lock occurs over a single circle of the gear 21. Between the gear 21 and the coupling plate 22 is a return spring capable of resetting the gear 21 to the position of FIG. 4 as soon as the electrical control for the actuator 10 is switched off and the load pressing the bolt or plunger 10*a* is released. The actuator 10 has its bolt or plunger 10*a* retained in the locked position also after the switch-off of electrical control until the pressure load applied thereon by the lever 27, 29 is removed.

The piezoelectric actuators 10 are commercially available, but have not been earlier applied in the way presented in this invention. Also other corresponding low energy actuators can be used.

Figure 2A:
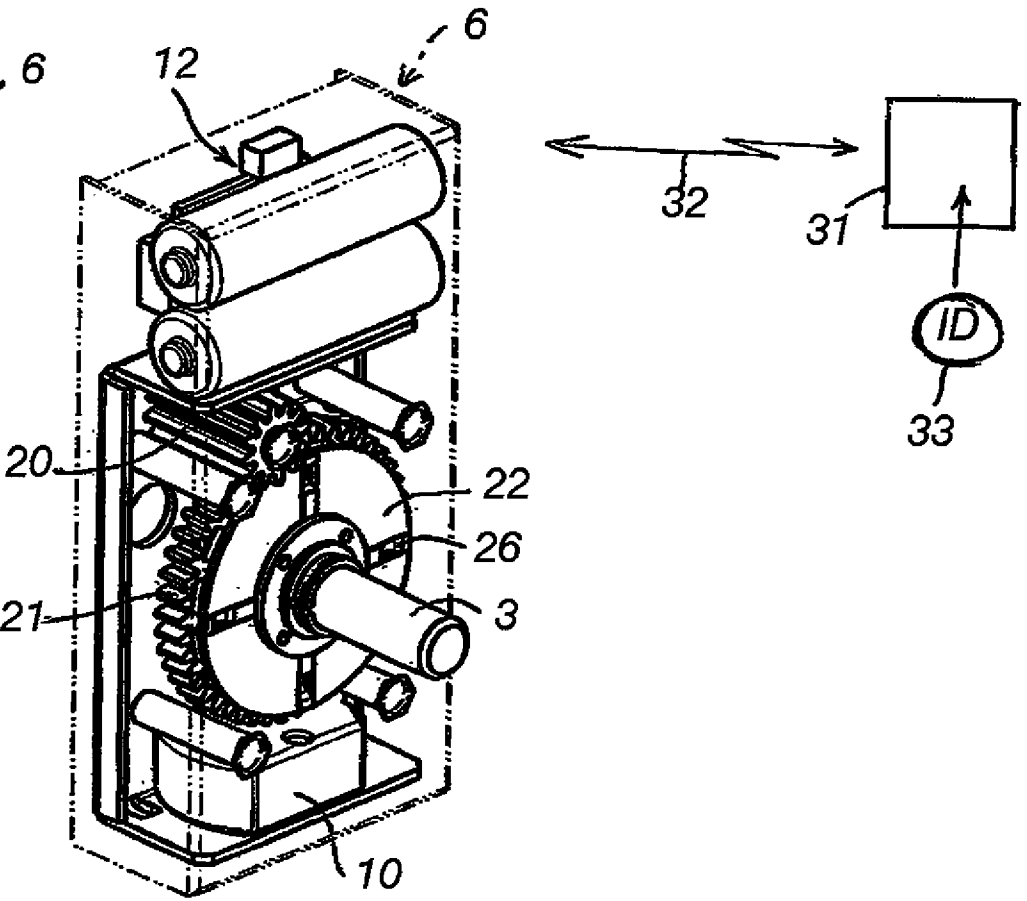
FIG. 2A shows in a perspective view a component of the electric lock of the invention mounted on the inside of a door, depicting also cooperation with an access control device.
Figure 2B:
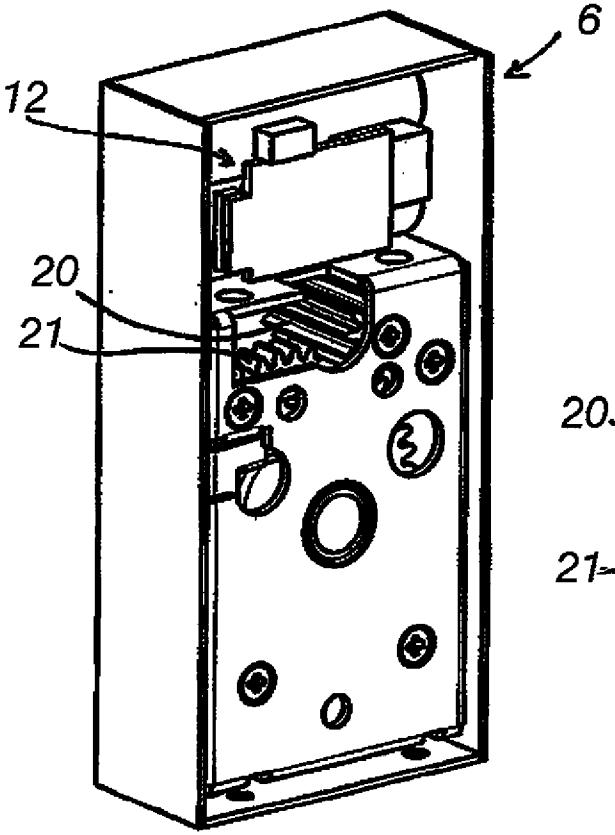
FIG. 2B shows the electric lock component of FIG. 2A as seen from the opposite side, in a perspective view.
Figure 3:
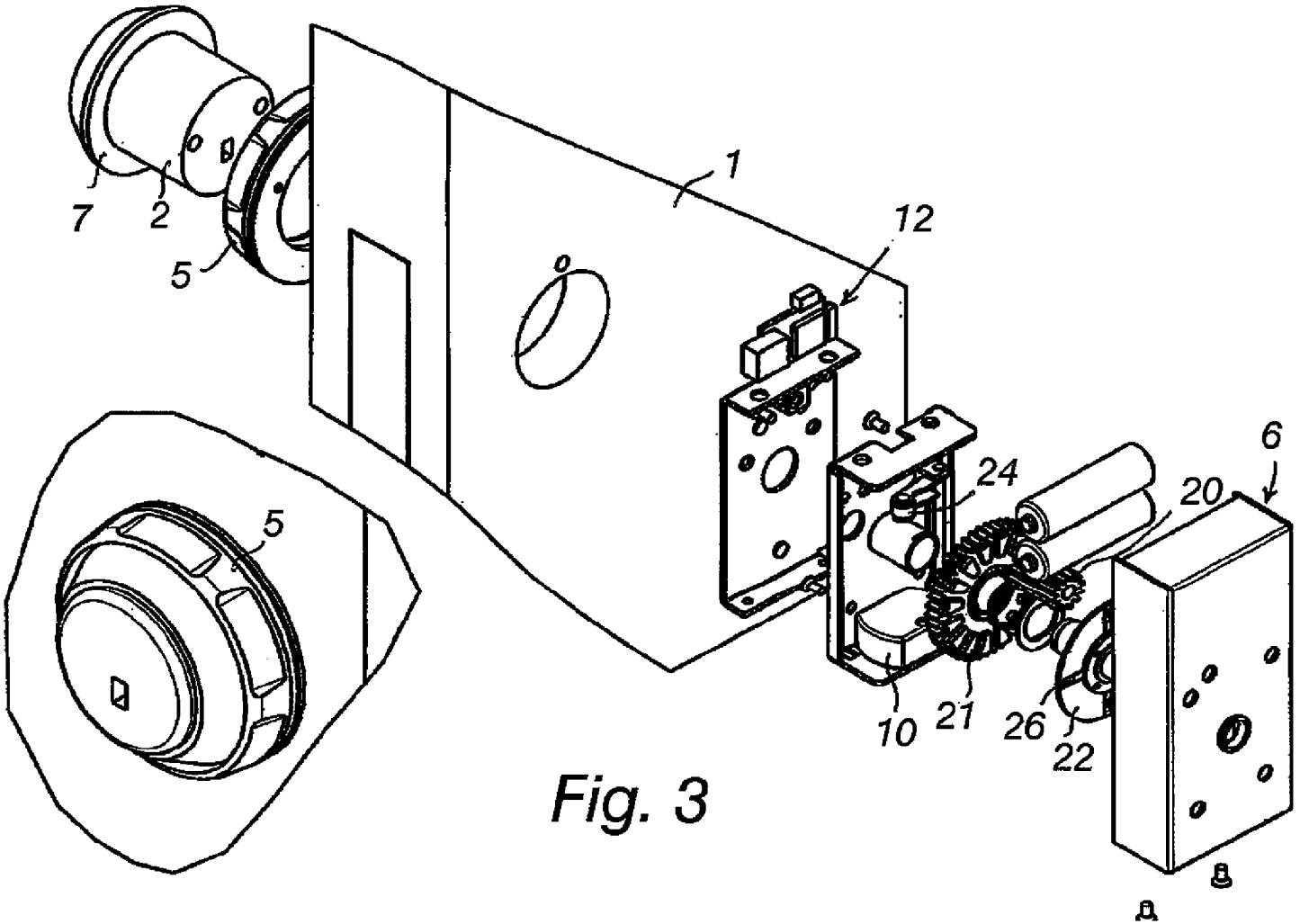
FIG. 3 shows an electric lock of the invention in an axonometric exploded view.

FIG. 2A shows that the output device for an electrical control 12, 31, 33 is in the form of an access control device 31, which can be used with a short range signal 32 to control electric locks present in several doors. An identification code tag, functioning as the key, is designated with reference numeral 33. Thus, the electric lock according to the invention provides the essential advantage of needing just one access control device 31 for controlling quite a large number of electric locks present in a number of doors. This provides for a substantial saving in costs.

Attained by the invention is also an automatic alarm function for unauthorized opening of a door. For this purpose, the electric lock includes an electric control reception and control unit 12, which is provided with a transmitter that sends a message to the access control device 31 in case of unauthorized opening of a door without an opening command from the access control device 31. Verification of an opening door can be carried out by a conventional magnetic detector. When the unit 12 receives a message from the magnetic detector, but has not received an opening code from the access control device 31, the message about unauthorized opening is transmitted to an alarm system. In FIG. 2A, this two-way communication link is indicated by an arrow 32.

In the present case, the drive link mechanism 41, 20, 21, 22 and the electrically controlled coupling elements 10, 21, 22, 24, 25, 26 are accommodated in a housing 6, which is located inside the door 1, i.e. on a side of the lock body 2*a* opposite to the key cylinder 2*b*. The opening spindle 4 extends through the door and can be for example a pliable wire cable.

Although the invention has been described in terms of an accessory for a conventional lock, it is obvious that the respective functions can also be provided in a newly designed lock for connection with the lock body 2*a*. Also, the finger wheel 5 can be any opening element such as a door handle.

The invention claimed is:

1. A wirelessly controlled electric lock, comprising a lock body (2*a*), a key cylinder (2*b*), a turn spindle (3) rotatable by a handle element (3*a*) internal of the door, the turning of which enables opening of the lock, an opening spindle (4) rotatable by an opening element (5) external of the door, a drive link mechanism (41, 20, 21, 22) enabling the turn spindle (3) and the opening spindle (4) to be coupled with each other for a drive link engagement, such that turning of the opening spindle translates also into a turning motion of the turn spindle, and electrically controlled coupling elements (10, 21, 22, 24, 25, 26), wherein the electrically controlled coupling elements include an actuator (10) which, in a mode activated by an electrical control (12, 31, 33) transmitted (32) wirelessly to the electric lock, is adapted to fixedly lock a bolt or plunger (10*a*) which, in its fixedly locked condition, enables or activates said drive link mechanism to effect the coupling of the drive link engagement in response to rotation of the opening spindle (4) by handforce, thereby enabling opening of the lock by continued rotation of the opening spindle (4), and, without electrical control of the actuator (10), said bolt or plunger (10*a*), upon yielding to the weak returning force of a spring or some other force device, is adapted to disable or not to activate the coupling of the drive link engagement as the opening spindle (4) is rotated.

2. An electric lock according to claim 1, wherein the actuator (10) is a piezoelectric actuator.

3. An electric lock according to claim 1, wherein the output device of the electrical control (12, 31, 33) is in the form of an access control device (31), which uses a short range signal (32) to control electric locks present in several doors.

4. An electric lock according to claim 3, wherein the electric lock includes an electrical control reception and control unit (12), which is provided with a transmitter adapted to send a message to the access control device (31) in case of opening of a door (1).

5. An electric lock according to claim 1, wherein the coupling elements include an axially displaceable gear (21), a cam wheel (24), and a guide surface (25) associated with the gear (21), by way of which the gear (21) is forced by the cam wheel (24) to proceed into the engagement with a coupling plate (22), the coupling plate (22) rotating along with the turn spindle (3) and the gear (21) rotating along with the opening element (5) external of the door.

6. An electric lock according to claim 1, wherein the opening element (5) external of the door is an annular finger wheel fitted around a lock cylinder (2).

7. An electric lock according to claim 6, wherein the finger wheel (5) has its internal periphery provided with a serration (5*a*), which is in a meshed engagement with a gear (4*b*) rotating the opening spindle (4).

8. An electric lock according to claim 5, wherein the opening spindle (4) has a gear (41) at one end thereof, with which the axially displaceable gear (21) is in meshed engagement through the intermediary of a transmission gear (20) in all of its displacement positions.

9. An electric lock according to claim 1, wherein the drive link mechanism (41, 20, 21, 22) and the electrically controlled coupling elements (10, 21, 22, 24,25,26) are accommodated in a housing (6), which is located inside a door on a side of the lock body (2*a*) opposite to the key cylinder (2*b*), and that the opening spindle (4) extends through the door.

10. An electric lock according to claim 9, wherein the opening spindle (4) is a pliable cable.

* * * * *